US006617302B2

(12) United States Patent
Ghatlia et al.

(10) Patent No.: US 6,617,302 B2
(45) Date of Patent: Sep. 9, 2003

(54) POLYCARBOXYLIC ACID CONTAINING THREE-IN-ONE DISHWASHING COMPOSITION

(75) Inventors: Naresh Dhirajlal Ghatlia, Rutherford, NJ (US); Yu-Min Catherine Chiou, Saddle Brook, NJ (US)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 0 days.

(21) Appl. No.: 10/320,115

(22) Filed: Dec. 16, 2002

(65) Prior Publication Data

US 2003/0130151 A1 Jul. 10, 2003

Related U.S. Application Data

(62) Division of application No. 09/658,175, filed on Sep. 8, 2000, now Pat. No. 6,521,576.

(51) Int. Cl.[7] ..... C11D 3/37
(52) U.S. Cl. ..... 510/476; 510/229
(58) Field of Search ..... 510/475, 476, 510/229

(56) References Cited

U.S. PATENT DOCUMENTS

| | | | | |
|---|---|---|---|---|
| 4,992,194 | A | 2/1991 | Liberati et al. | |
| 5,547,612 | A | 8/1996 | Austin et al. | |
| 5,837,663 | A | 11/1998 | Nicholson et al. | |
| 5,859,286 | A | 1/1999 | Yamaguchi et al. | |
| 5,939,373 | A | 8/1999 | Haeggberg et al. | |
| 5,958,855 | A | 9/1999 | Binstock et al. | |
| 6,326,343 | B1 | 12/2001 | Ghatlia et al. | |
| 6,521,576 | B1 * | 2/2003 | Ghatlia et al. | 510/229 |

FOREIGN PATENT DOCUMENTS

| | | |
|---|---|---|
| DE | 197 27 073 A1 | 1/1999 |
| EP | 0851022 A2 | 7/1998 |
| WO | 95/00624 | 1/1995 |
| WO | 95/32271 | 11/1995 |
| WO | 96/00277 | 1/1996 |
| WO | 98/26036 | 6/1998 |
| WO | 99/00470 | 1/1999 |
| WO | 99/58633 | 11/1999 |
| WO | 00/06688 | 2/2000 |

OTHER PUBLICATIONS

International Search Report Application No. PCT/EP 01/09274 mailed Jan. 18, 2002 (for parent application, U.S. Serial No. C6581(C) filed Sep. 8, 2000.

* cited by examiner

*Primary Examiner*—John Hardee
(74) *Attorney, Agent, or Firm*—Ronald A. Koatz

(57) ABSTRACT

A dishwashing composition with hydrophobically modified polycarboxylic acids and water soluble entities that reduce phosphate scale formation is described. The dishwashing composition displays excellent cleaning benefits and glass appearance, even in the absence of NaCI additives and conventional rinse aid compositions.

2 Claims, No Drawings

POLYCARBOXYLIC ACID CONTAINING THREE-IN-ONE DISHWASHING COMPOSITION

Div. of Ser. No. 09/658/175, filed Sep. 8, 2000, now U.S. Pat No. 6,521,576.

FIELD OF THE INVENTION

This invention is directed to a composition for use in a dishwashing machine. More particularly, the invention is directed to a superior dishwashing composition that has a hydrophobically modified polycarboxylic acid and a water soluble polymer that reduces phosphate scale formation. The dishwashing composition unexpectedly results in excellent cleaning properties and excellent glass appearance when used to clean glassware even in the presence of hard water and in the absence of conventional rinse aid compositions.

BACKGROUND OF THE INVENTION

Dishwashing compositions constitute a generally recognized distinct class of detergent compositions, particularly when compared to detergents designed for fabric washing. For example, the ultimate dishwashing composition results in a spotless and film-free appearance on glassware and silverware after a cleaning cycle in a dishwashing machine. In fabric washing operations, on the otherhand, detergent compositions which result in greasy, oily or soapy residues on items that were cleaned can be tolerated.

Often, washing articles in a commercially available dishwashing machine entails using three products. Salt is added to the salt compartment to recharge the ion exchanger which softens the water, a dishwashing formulation is used to clean the articles and a rinse aid is used to ensure that the articles are rinsed with no streaks or smears. Consumers generally find it very inconvenient, however, to replace or refill such products.

In order to provide convenient products to consumers, manufacturers have been making dishwashing tablets in order to eliminate detergent handling and dosing issues. Such tablets often have a detergent portion, and a wax portion which contains a rinse aid. These types of tablets, which are sometimes referred to as 2-in-1 tablets, have disadvantages since they may only be used in a wash cycle that does not exceed 55° C. This is true because the wax portion which contains the rinse aid will completely dissolve in a wash cycle that exceeds 55° C. This causes all of the rinse aid to drain out of the dishwashing machine before the actual rinse cycle. Furthermore, such 2-in-1 tablets require that salt be added to the dishwashing machine in order to obtain optimal results, and they are very complicated and expensive to produce.

Other types of tablets that are well known are often referred to as pH sensitive 2-in-1 tablets . These types of tablets have a detergent portion and rinse aid portion that is contained in a pH sensitive material. The pH sensitive 2-in-1 tablets may be used in wash cycles that exceed 55° C. However, like the detergent tablets with the wax portion, the pH sensitive 2-in-1 tablets require that salt be added to the dishwashing machine in order to obtain optimal cleaning results and they are extremely expensive to produce.

In view of the vast deficiencies of the conventional products, it is of increasing interest to provide a dishwashing composition, such as a dishwashing tablet, that works well at all wash temperatures of a dishwashing system (even temperatures greater than 55° C.), provides antiscaling benefits in a system that is high in phosphate content (in hard water), does result in excellent cleaning benefits in water that has not been subjected to conventional water softening additives (i.e., hard water) and provides a glossy glassware appearance in the absence of conventional rinse aid compositions. This invention, therefore, is directed to a dishwashing composition that has a hydrophobically modified polycarboxylic acid and a water soluble polymer that reduces phosphate scale formation on glassware being cleaned. The dishwashing composition is superior in that it unexpectedly results in excellent cleaning properties, and reduced spotting and scale formation even when no salt is added to the dishwashing machine to soften hard water, when washing cycles exceed a temperature of 55° C., and when no rinse aid composition is added to the dishwashing machine. In fact, the present invention is directed to a superior 3-in-1 detergent composition that is inexpensive to produce and very easy for the consumer to use.

BACKGROUND MATERIAL

Efforts have been made to prepare dishwashing compositions. In U.S. Pat. No. 5,939,373, an automatic dishwashing detergent composition comprising a phosphate builder and a metal containing bleach catalyst is described.

Still other efforts have been disclosed for making dishwashing compositions. In WO 00/06688, a dishwashing composition with a coated core is described. The coated core has a substance that exerts function in a clear rinse cycle.

Even further, other efforts have been disclosed for making dishwashing compositions. In DE 197 27 073 A1, coated detergent components are described.

None of the material above describes a dishwashing composition that has a hydrophobically modified polycarboxylic acid and a water soluble polymer that reduces phosphate scale formation wherein the dishwashing composition results in excellent cleaning properties and glass appearance when used, for example, in the presence of hard water, in the absence of rinse aid compositions and even in a washing cycle that exceeds a temperature of 55° C.

SUMMARY OF THE INVENTION

In a first aspect, the present invention is directed to a hard water dishwashing composition effective for cleaning and reducing spotting and phosphate scale formation on glassware, the dishwashing composition comprising:

a) a hydrophobically modified polycarboxylic acid; and b) a water soluble polymer that reduces phosphate scale formation.

In a second aspect, this invention is directed to a method for minimizing spotting and phosphate scale formation on glassware being cleaned, comprising the steps of:

a) subjecting the glassware to a dishwashing composition comprising a hydrophobically modified polycarboxylic acid, and a water soluble polymer that reduces phosphate scale formation;

b) subjecting the glassware to hard water; and c) removing the glassware from the hard water wherein the glassware is not subjected to a rinse aid composition.

In a third aspect, this invention is directed to a package comprising the dishwashing composition described in the first aspect of this invention and instructions not to use a rinse aid composition or conventional water softening salts or both.

As used herein, glassware is defined to include drinking glasses and any other articles typically found in a commercial or domestic dishwasher.

DETAILED DESCRIPTION OF THE PREFERRED EMBODIMENTS

As used in this invention, a hydrophobically modified polycarboxylic acid is defined to mean a compound, oligomer or polymer having at least one carboxylic acid group and at least one group that is not water soluble. There generally is no limitation with respect to the type of hydrophobically modified polycarboxylic acid that may be used in this invention other than that the polycarbocylic acid can be used in a dishwashing composition that comprises a water soluble polymer that reduces phosphate scale formation. Such a hydrophobically modified polycarboxylic acid often has a weight average molecular weight of greater than about 175 and less than about 1.5 million, and preferably, greater than about 200 and less than about 1 million; and most preferably, greater than about 225 and less than about 750 thousand, including all ranges subsumed therein.

The preferred hydrophobically modified polycarboxylic acid which may be used in this invention comprises at least one structural unit of the formula:

(I)

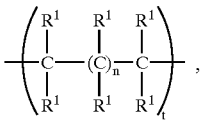

, and (II)

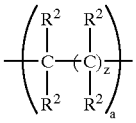

wherein each $R^1$ and $R^2$ are independently a hydrogen, hydroxy, alkoxy, carboxylic acid group, carboxylic acid salt, ester group, amide group, aryl, $C_{1-20}$ alkyl, $C_{2-20}$ alkenyl, $C_{2-20}$ alkynyl or a polyoxyalkylene condensate of an aliphatic group, n is an integer from about 0 to 8, z is an integer from about 1 to about 8, t is an integer from about 0 to about 2,000 and a is an integer from about 0 to about 2,000, with the proviso that a and t are not simultaneously 0 and at least one $R^1$ or one $R^2$ is a carboxylic acid group, or a salt thereof.

In a preferred embodiment, the hydrophobically modified polycarboxylic acid used in this invention comprises at least one structural unit represented by formula I ($t \geqq 1$) with at least one $R^1$ as a carboxylic acid group (or salt thereof), and at least one structural unit represented by formula II ($a \geqq 1$) with at least one $R^2$ group as a $C_{4-20}$ alkyl group or a $C_{8-30}$ ethoxylated condensate of an aliphatic group.

In a most preferred embodiment, however, the modified polycarboxylic acid used in this invention comprises structural units represented by formula I and structural units represented by formula II wherein a is from about 80% to about 120% of t, and at least two $R^1$ groups are carboxylic acid groups (or salts thereof) and at least one $R^2$ group is a methyl group and at least one $R^2$ group is a $C_5$ alkyl, and n is 0 and z is 1.

The hydrophobically modified polycarboxylic acids which may be used in this invention are typically prepared by reacting the desired precursors ($sp^2$ bonded monomers) under free radical polymerization conditions. Such polycarboxcylic acids are also commercially available from suppliers like Rohm & Haas and DuPont. A more detailed description of the types of hydrophobically modified polycarboxylic acids which may be used in this invention, including the process for making the same, may be found in U.S. Pat. No. 5,232,622, the disclosure of which is incorporated herein by reference.

The preferred and most preferred hydrophobically modified polycarboxylic acids are made available by Rohm & Haas under the names Acusol 820 and 460, respectively.

There is generally no limitation with respect to how much hydrophobically modified polycarboxylic acid may be used in this invention other than the amount used results in a dishwashing composition. Typically, however, from about 0.1 to about 10.0, and preferably, from about 0.2 to about 7.0, and most preferably from about 0.3 to about 5.0% by wt. of the dishwashing composition is a hydrophobically modified polycarboxylic acid, based on total weight of the dishwashing composition, including all ranges subsumed therein.

As to the water soluble polymer that reduces phosphate scale formation, such a polymer often comprises at least one structural unit derived from a monomer having the formula:

(III)

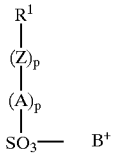

wherein $R^1$ is a group comprising at least one $sp^2$ bond, Z is O, N, P, S, or an amido or ester link, A is a mono- or a polycyclic aromatic group or an aliphatic group and each p is independently 0 or 1 and $B^+$ is a monovalent cation.

Preferably, $R^1$ is a $C_2$ to $C_6$ alkene (most preferably ethene or propene). When $R^1$ is ethenyl, Z is preferably amido, A is preferably a divalent butyl group, each p is 1, and $B^+$ is $Na^+$. Such a monomer is polymerized and sold as Acumer 3100 by Rohm & Haas.

Another preferred embodiment exists when the water soluble polymer is derived from at least one monomer with $R^1$ as 2-methyl-2-propenyl, Z as oxygen, A as phenylene, each p as 1 and $B^+$ as $Na^+$, and at least one monomer with $R^1$ as 2-methyl-2-propenyl, each p as 0 and $B^+$ as $Na^+$. Such monomers are polymerized and sold under the name Alcosperse 240 by Alco Chemical.

It is further noted herein that it is within the scope of this invention for all the polymers used to be a homopolymer or copolymer, including terpolymers. Furthermore, the polymers of this invention may be terminated with conventional termination groups resulting from precursor monomers and/or initiators that are used.

There is generally no limitation with respect to how much water soluble polymer that reduces phosphate scale formation is used in this invention as long as the amount used results in a dishwashing composition. Often, from about 0.5 to about 10.0, and preferably, from about 1.0 to 7.0, and most preferably, from about 1.5 to about 4.5% by weight water soluble polymer is used, based on total weight of the dishwashing composition, including all ranges subsumed therein. These water soluble polymers typically have a weight average molecular weight from about 1,000 to about 50,000.

Phosphate containing builders are a preferred additive in this invention. Such builders typically make up from about 5.0 to about 75.0% by weight of the total weight of the dishwashing composition, including all ranges subsumed therein. Preferably, however, the amount of phosphate containing builder employed is from about 10.0 to about 70.0, and most preferably, from about 15.0 to about 65.0% by weight based on total weight of the dishwashing composition and including all ranges subsumed therein. The phosphate containing builders which may be used in this invention are well known, for example, for binding metals such as Ca and Mg ions, both of which are often abundant in hard water found in dishwashing machines. An illustrative list of the phosphate builders which may be used in this invention include sodium, potassium and ammonium pyrophosphate; alkali metal tripolyphosphates, sodium and potassium orthophosphate and sodium polymetaphosphate, with sodium tripolyphosphate being especially preferred.

Other additives which may be used in this invention include well known items such as perfumes, antifoaming agents, anti-tarnish agents, and processing aids (e.g., polyethylene glycol) which aid in forming tablet-type dishwashing compositions. Such additives, collectively, do not normally make up more than about 8.0% by weight of the total weight of the dishwashing composition.

It is also within the scope of this invention to use conventional dishwashing bleaches and activators (from e.g., from about 0.02 wt. % to about 25.0 wt. %, based on total weight of the dishwashing composition). Such bleaches include inorganic and organic peracids as well as salts thereof. Examples include epsilon phthalimido perhexanoic acid and Oxone®, respectively.

Other bleaches which may be used in this invention include hydrogen peroxide and its precursors (e.g., sodium perborate and sodium percarbonate).

If desired, conventional bleach activators (including catalysts) may be used with the bleaches described herein. These activators include N,N,N',N'-tetraacetylethylenediamine, nonanyoloxybenzenesulfonate, cationic nitriles, cholyl(4-sulfophenyl)carbonate, and quaternary imine salts (e.g., N-methyl-3,4-dihydrooisoquinolinium p-toluenesulfonate).

Other bleach activators which may be used include transition metal-containing bleach catalysts such as $[Mn^{IV}{}_2(\mu\text{-}0)_3(Me_3TACN)_2](PF_6)_2$ (as described in U.S. Pat. Nos. 4,728,455, 5,114,606, 5,153,161, 5,194,416, 5,227,084, 5,244,594, 5,246,612, 5,246,621, 5,256,779, 5,274,147, 5,280,117), $[Fe^{II}(MeN4py)(MeCN)](ClO_4)_2$ (as described in EP 0 909 809) and $[Co^{III}(NH_3)_5(OAc)](OAc)_2$ (as described in U.S. Pat. No. 5,559,261, WO 96/23859, WO 96/23860, WO 96/23861), the disclosures of which are incorporated herein by reference.

It is also within the scope of this invention to employ conventional dishwashing enzymes and buffers. The former typically make up from about 0.5 to about 10.0% by weight of the total weight of the dishwashing composition and include proteases like Savinase®, Purafect Ox® and Properase® and amylases like Termamyl®, Purastar ST® and Purastar Ox Am®, all of which are commercially available. The latter typically make up from about 5.0 to about 25.0% by weight of the total weight of the dishwashing composition and include well known buffers like sodium disilicate, sodium metasilicate and sodium carbonate.

When washing glassware with the dishwashing composition of this invention, soiled glassware is typically placed in a conventional domestic or commercial dishwashing machine as is the dishwashing composition of this invention (in no particular order). The dishwashing composition, in the form of a liquid, powder or detergent tablet, preferably a tablet, then dissolves in the water of the dishwasher to wash the glassware. The typical dishwashing cycle is from about 10 minutes until about 60 minutes and the typical temperature of the water in the dishwasher is from about 40° C. to about 70° C. The glassware resulting from the above-described cleaning method is clean and has an excellent glass appearance (i.e., substantially free of film and spots). Such results are unexpectedly obtained even when hard water at high temperatures (greater than 55° C.) is used, in the absence of rinse aid compositions.

When marketing the superior dishwashing composition of this invention, it is preferred that the dishwashing composition is formed into a tablet and sold in a package with directions to add the dishwashing composition to the dishwashing machine as a 3-in-1 product. Thus, a dishwasher is charged with the dishwashing composition of this invention without having to add to the dishwasher conventional rinse aid compositions and sodium chloride.

The Examples below are provided to further illustrate an understanding of the present invention, and they are not intended to limit the scope of the invention as set forth in the claims.

TABLE 1

Abbreviations used in the Examples

| | |
|---|---|
| AA | Polyacrylic acid |
| AMPS | 2-Acrylamido-2-methylpropane sulfonic acid |
| DIB | diisobutylene |
| HEDP | 1-hydroxyethylene-1,1-diphosphonic acid |
| MA | Maleic acid |
| MMA | Methyl methacrylate |
| SMS | 2-Methyl-2-propene-1-sulfonic acid, sodium salt |
| SPME | 4-[(2-Methyl-2-propenyl)oxy]benzenesulfonic acid, sodium salt |

TABLE 2

Base Formulation used in Examples

| Ingredients | % wt |
|---|---|
| Sodium tripolyphosphate | 64.1 |
| Sodium disilicate | 20.5 |
| Sodium perborate monohydrate | 9.5 |
| Tetraacetyl ethylene diamine - 83% | 2.5 |
| Enzymes* | 3.3 |
| 1,2,3-Benzotriazole | 0.05 |

*An enzyme mix of protease and amylase, provided by Novo.

All dishwashing machine tests were carried out using a Miele G656 dishwasher setting at the 55° C. Normal program, which consisted of a main wash (heated to 55° C.), followed by a cold rinse and a heated (to 65°C.) final rinse with a non-heated drying cycle. Water hardness was adjusted to contain 300 ppm of total hardness ($Ca^{2+}$: $Mg^{2+}$=4:1, expressed as $CaCO_3$) and 320 ppm of temporary hardness by addition of sodium bicarbonate (overall expressed as 300/320 ppm water hardness). Typical dishware set used for machine dishwasher tests included the following articles: (1) on the upper rack: 8 clean drinking glasses, 2 lipstick stained drinking glasses 1 Tupperware container and 4 tea stained cups; and (2) on the lower rack: 4 ceramic and 4 stainless steel plates with baked-on egg yolk soil, 4 wheat soiled, 4 potato soiled and 4 Roux Blanc soiled ceramic plates. In addition, 40 grams of ASTM standard food soil, described in Section 5.2 of ASTM Method D 3556-85, "Standard Test Method for Deposition on Glassware During mechanical Dishwashing" was spread on the dishwasher door prior to the beginning of each machine test. This soil consists of 80% margarine and 20% low fat powdered milk.

When a cleaning test was ready to be started, 18 g of base formulation (Table 2) was added in the dispenser cup of the dishwasher. In addition, 0.90 g of a hydrophobically modified polycarboxylic acid and 0.54 g of antiscalant were dosed via the dispenser cup or added directly into the machine at the dispenser cup opening in the beginning of the main wash, except for the control run, where no antiscalant was added in the test.

The hydrophobically modified (co)polymers used were:

EXAMPLES 1–6

Acusol 460, a copolymer of diisobutylene and maleic acid, MW 15,000, supplied by Rohm and Haas Company;

EXAMPLES 7–12

Acusol 820, a copolymer of acrylic acid with $C_{18}$ and with $EO_{20}C_{18}$ side chains, MW about 500,000, supplied by Rohm and Haas Company.

At the end of a complete machine run, drinking glasses were removed and graded inside a viewing cabinet according to extent of spotting and filming on glasses. Both spotting and filming scores were recorded based on area covered by and intensity of spots and film, respectively. Spotting scores are expressed on a 0 to 4 scale and filming scores are recorded on a 0 to 5 scale, 0 being completely free of spots or film. The sum of spotting and filming score indicates the overall glass appearance, i.e. higher the total score meaning poorer final glass appearance. Results are recorded in Tables 3 and 4.

EXAMPLES 1–6

TABLE 3

Effect of antiscalant and a hydrophobically modified polymer on glass appearance*

| Example | Hydrophobically Modified Polymer[1] | Antiscalant | Glass Spot | Glass Film | Total Score |
|---|---|---|---|---|---|
| 1 (Control) | MA/DIB | None | 3.5 | 0.4 | 3.9 |
| 2 (Invention) | MA/DIB | AA/MMA/SPME/SMS[2] | 0.7 | 1.0 | 1.7 |
| 3 (Invention) | MA/DIB | AA/AMPS[3] | 0.9 | 1.0 | 1.9 |
| 4 (Comparative) | MA/DIB | Homopolymer of acrylic acid[4] | 2.4 | 0.7 | 3.1 |
| 5 (Comparative) | MA/DIB | Mixture of acrylate homopolymer[5] and acrylate/maleate copolymer[6] (1:2 w/w) | 1.7 | 0.6 | 2.3 |
| 6 (Comparative) | MA/DIB | Mixture of acrylate homopolymer[5] and HEDP[7] (3:1 w/w) | 1.6 | 0.9 | 2.5 |

*Glass appearance is judged by residual film and spots, i.e., higher the total score of spot and film indicating poorer glass appearance.
[1]The hydrophobically modified polymer is Acusol 460, supplied by Rohm and Haas.
[2]Alcosperse 240 supplied by Alco Chemical.
[3]Acumer 3100 supplied by Rohm and Haas.
[4]Acusol 445 supplied by Rohm and Haas.
[5]Sokalan PA25 supplied by BASF.
[6]Sokalan CP5 supplied by BASF.
[7]Dequest 2016 supplied by Solutia Chemical.

EXAMPLES 7–12

TABLE 4

Effect of antiscalant and a hydrophobically modified polymer on glass appearance*

| Example | Hydrophobically Modified Polymer[1] | Antiscalant | Glass Spot | Glass Film | Total Score |
|---|---|---|---|---|---|
| 7 (Control) | AA with $C_{18}$ and $EO_{20}C_{18}$ | None | 1.9 | 1.1 | 3.0 |
| 8 (Invention) | AA with $C_{18}$ and $EO_{20}C_{18}$ | AA/MMA/SPME/SMS[2] | 1.2 | 0.7 | 1.9 |
| 9 (Invention) | AA with $C_{18}$ and $EO_{20}C_{18}$ | AA/AMPS[3] | 1.1 | 1.3 | 2.4 |
| 10 (Comparative) | AA with $C_{18}$ and $EO_{20}C_{18}$ | Homopolymer of acrylic acid[4] | 1.8 | 0.9 | 2.7 |
| 11 (Comparative) | AA with $C_{18}$ and $EO_{20}C_{18}$ | Mixture of acrylate homopolymer[5] and acrylate/maleate copolymer[6] (1:2 w/w) | 3.2 | 0.6 | 3.8 |
| 12 (Comparative) | AA with $C_{18}$ and $EO_{20}C_{18}$ | Mixture of acrylate homopolymer[5] and HEDP[7] (3:1 w/w) | 2.2 | 0.8 | 3.0 |

*Glass appearance is judged by residual film and spots, i.e. higher the total score of spot and film indicating poorer glass appearance.
[1]The hydrophobically modified polymer is Acusol 820, supplied by Rohm and Haas
[2]Alcosperse 240 supplied by Alco Chemical.
[3]Acumer 3100 supplied by Rohm and Haas.
[4]Acusol 445 supplied by Rohm and Haas.
[5]Sokalan PA25 supplied by BASF.
[6]Sokalan CPS supplied by BASF.
[7]Dequest 2016 supplied by Solutia Chemical.

As shown in Tables 3 and 4, in the absence of the superior antiscalant of this invention, the hydrophobically modified polycarboxylate in Examples 1 and 7 did not yield satisfactory glass appearance under hard water washing conditions.

The combination of a hydrophobically modified polycarboxylic acid and a antiscaling polymer containing sulfonated monomeric units greatly and unexpectedly reduces residual spotting and filming on washed glassware, thus giving enhanced glass appearance under hard water washing conditions (Examples 2, 3, 8 and 9). Conventional dispersing polymers, such as non-modified polycarboxylate polymers, in fact, cause an increase in number of spots on glassware; as such, giving worsened glass appearance (Examples 4, 5, 10 and 11). Inclusion of a diphosphonate de-scaling sequestrant (such as HEDP) does not provide any benefit on enhancing overall glass appearance (Examples 6 and 12).

What is claimed is:

1. A dishwashing composition effective for cleaning glassware in hard water, the dishwashing composition comprising:

(a) a hydrophobically modified polycarboxylic acid; and (b) a water soluble polymer that reduces phosphate scale formation;

wherein said polycarboxylic acid (a) comprises at least one structural unit selected from the group consisting of:

(I)

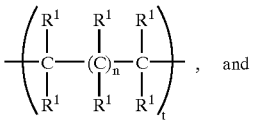

, and (II)

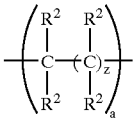

wherein each $R^1$ and $R^2$ are independently a hydroxy, alkoxy, carboxylic acid group, carboxylic acid salt, ester group, amide group, or a polyoxyalalkylene of an aliphatic group;

wherein t is an integer from about 0 to about 2,000, a is an integer from about 0 to about 2,000, t≧1, a≧1, a is an integer that is from about 80% to 100% of t, n=0, z=1, at least two $R^1$ groups are carboxylic acid groups or salts thereof, and at least one $R^2$ group is $C_4$-$C_{20}$ alkyl or $C_8$-$C_{30}$ ethoxylated condensate of an aliphatic group; and wherein said water soluble polymer (b) has a polymer backbone has a polymer backbone comprising at least one structural unit derived from a monomer having the formula:

(III)

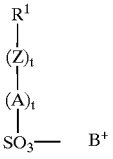

wherein $R^1$ is a group comprising at least one $sp^2$ bond, Z is O, A is a mono- or a polycyclic aromatic group or an aliphatic group and each t is independently 0or 1and $B^+$ is a monovalent cation.

2. A dishwashing composition effective for cleaning glassware in hard water, the dishwashing composition comprising:

(c) a hydrophobically modified polycarboxylic acid; and (d) a water soluble polymer that reduces phosphate scale formation;

wherein said polycarboxylic acid (a) comprises at least one structural unit selected from the group consisting of:

(I)

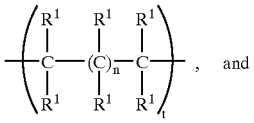

, and (II)

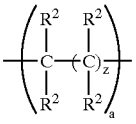

wherein each $R^1$ and $R^2$ are independently a hydrogen, hydroxy, alkoxy, carboxylic acid group, carboxylic acid salt, ester group, amide group, aryl, $C_{1-20}$ alkyl, $C_{2-20}$ alkenyl, $C_{2-20}$ alkynyl or a polyoxyalkylene condensate of an aliphatic group;

wherein t is an integer from about 0 to about 2,000, a is an integer from about 0 to about 2,000, t≧1, a≧1, a is an integer that is from about 80% to 100% of t, n=0, z=1, at least two $R^1$ groups are carboxylic acid groups or salts thereof, and at least one $R^2$ group is $C_4$-$C_{20}$ alkyl or $C_8$-$C_{30}$ ethoxylated condensate of an aliphatic group; and wherein said water soluble polymer (b) has a polymer backbone has a polymer backbone comprising at least one structural unit derived from a monomer having the formula:

(III)

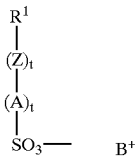

wherein $R^1$ is a group comprising at least one $sp^2$ bond, Z is N, P, S, or an amido or ester link, A is a mono- or a polycyclic aromatic group or an aliphatic group and each t is independently 0 or 1 and $B^+$ is a monovalent cation.

* * * * *